US006227621B1

(12) United States Patent
Chen

(10) Patent No.: US 6,227,621 B1
(45) Date of Patent: May 8, 2001

(54) BATHING BALL STRUCTURE

(76) Inventor: Ching-Chen Chen, 80-2, Wen Yuan Road, Pei Tou Town, Changhua (TW)

( * ) Notice: Subject to any disclaimer, the term of this patent is extended or adjusted under 35 U.S.C. 154(b) by 0 days.

(21) Appl. No.: 09/262,322

(22) Filed: Mar. 4, 1999

(51) Int. Cl.[7] ..... A47L 13/10; A47L 17/08

(52) U.S. Cl. ..... 300/21; 15/209.1; 15/229.11; 15/229.12; 15/229.13

(58) Field of Search ..... 15/209.1, 229.11, 15/229.12, 229.13; D28/63; D32/40; 601/134, 135, 136, 137, 138; 300/21

(56) References Cited

U.S. PATENT DOCUMENTS

| | | | | |
|---|---|---|---|---|
| 1,865,785 | * | 7/1932 | Parker | 15/209.1 |
| 2,581,779 | * | 1/1952 | Abraham | 15/229.11 |
| 4,462,135 | * | 7/1984 | Sanford | 15/229.12 |
| 5,758,386 | * | 6/1998 | Chen | 15/209.1 |
| 5,784,747 | * | 7/1998 | Giradot et al. | 15/209.1 |
| 5,802,659 | * | 9/1998 | Chang | 15/209.1 |
| 5,850,662 | * | 12/1998 | Galvan-Garza | 15/209.1 |
| 5,915,434 | * | 6/1999 | Juarez | 15/244.3 |
| 5,944,032 | * | 8/1999 | Masterson | 15/229.11 |
| 5,947,564 | * | 9/1999 | Chen | 15/209.1 |
| 5,983,435 | * | 11/1999 | Osborne | 15/229.11 |

* cited by examiner

*Primary Examiner*—Krisanne Thornton
(74) *Attorney, Agent, or Firm*—Rabin & Champagne, P.C.

(57) ABSTRACT

A bathing ball structure includes a soft rhombic-shaped synthetic open-mesh material woven into a tubular webbed band of predetermined length, of which the round opening of the webbed band is slipped vertically onto a U-shaped frame and continuously pulled over until a number of annular plies have accumulated, a binding cord is then wound around the outer extent of the webbed band, at which time a bathing ball or other three-dimensional animal or plant decoration is inserted between the numerous annular plies and the binding cord. Next, the binding cord is firmly tied to enable the two sides of the annular plies to be removed by first lifting the left and then the right extent of the U-shaped frame, thereby producing an irregular puff-like object of graduated loops, with the loops of the webbed band covering the bathing ball or other decoration formed, which enables the irregularities of the webbed band on the surface of the bathing ball to remain consistently saturated with a foam bathing solution while being utilized to scrub the body, with the structure also serving to massage the body at the same time. Furthermore, the invention herein also effectively allows for the structural enhancement of the appearance of the bathing ball.

6 Claims, 3 Drawing Sheets

BATHING BALL STRUCTURE

BACKGROUND OF THE INVENTION

1. Field of the Invention

The present invention is a bathing ball structure capable of remaining consistently saturated with a foam bathing solution when being utilized to continously scrub and massage the body, and furthermore, that effectively enhances of the appearance of the bathing ball.

2. Description of the Prior Art

The structure of conventional bathing balls available on the market consists of a long tubular webbed band having a number of continuous annular plies relative to the openings after a cord is tied around the outer extent of the webbed band to hold the material together tightly, the surface of the webbed belt is shaped into a fixed linear form, with the bathing ball now being capable of absorbing a foam bath solution for scrubbing the body. However, due to the fixed form of the surface of the webbed belt, maintaining the foam bath solution on the surface of the bathing ball is difficult and the foam bath lotion rapidly drops off. As such, the user must constantly re-apply the foam bath lotion while scrubbing the body, which keeps the user's hand preoccupied and defeats the original intent of physical relaxation. Furthermore, since the conventional bathing ball is of a fixed linear form, there are no progressive capabilities and the product is clearly drab, and especially inept for encouraging children to learn the habit and develop an interest in taking a bath. In view of the numerous drawbacks of current bathing ball structures, the inventor of the invention herein, based on many years of engagement in the manufacturing and marketing in the related industry and the winning of several other patents, conducted extensive research to improve and innovate upon the conventional product and thereby develop the content of the invention herein, which is now submitted in application for the granting of the commensurate patent rights.

SUMMARY OF THE INVENTION

The primary objective of the invention herein is to provide a bathing ball structure having a soft rhombic-shaped synthetic open-mesh material woven into a tubular webbed band of a predetermined length, of which the round opening of the webbed band is slipped vertically onto a U-shaped frame and continuously pulled over until a number of annular plies have accumulated. A binding cord is then wound around the outer extent of the webbed band, at which time a bathing ball or other three-dimensional animal or plant decoration is inserted between the numerous annular plies and the binding cord. Next, the binding cord is firmly tied to enable the two sides of the annular plies to be removed by first lifting the left and then the right extent off the U-shaped frame, thereby producing an irregular puff-like object of graduated loops, with the loops of the webbed band covering the bathing ball or other decoration formed, which enables the irregularities of the webbed band on the surface of the bathing ball to remain consistently saturated with a foam bathing solution while being utilized to scrub the body, with the structure also serving to massage the body at the same time. Furthermore, the invention herein also effectively allows for the structural enhancement of the appearance of the bathing ball.

DETAILED DESCRIPTION OF THE INVENTION

Figure 1:
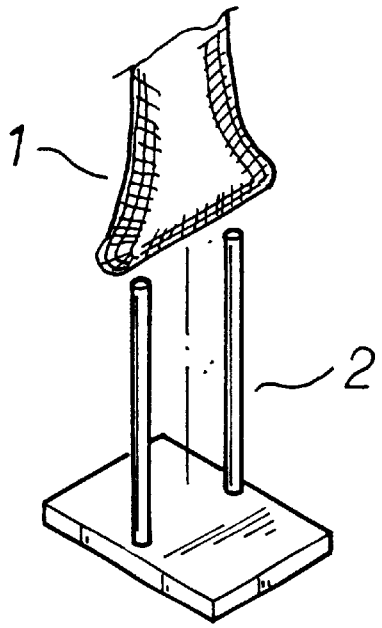
FIGS. 1–8 illustrate the production process of the invention herein.
Figure 3:
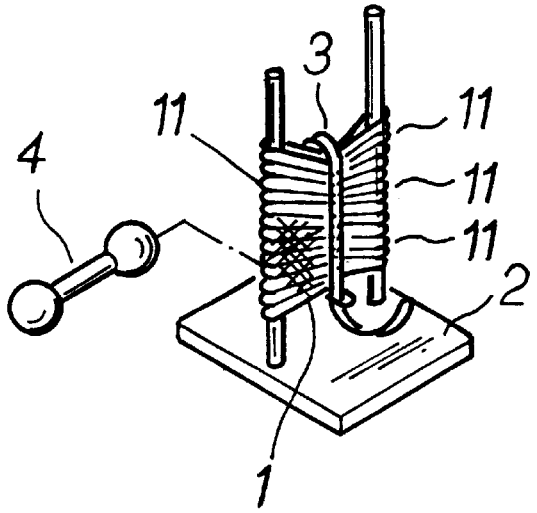
Figure 2:
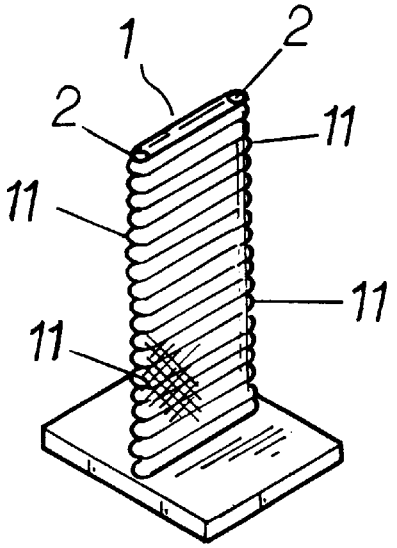
Figure 4:
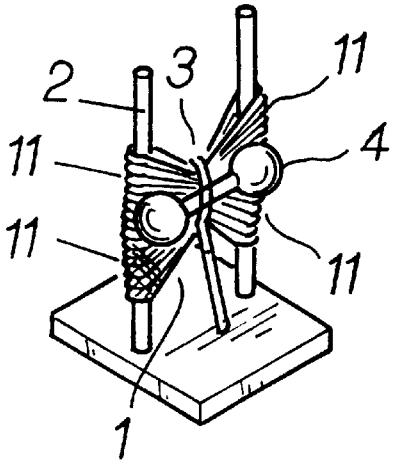
Figure 5:
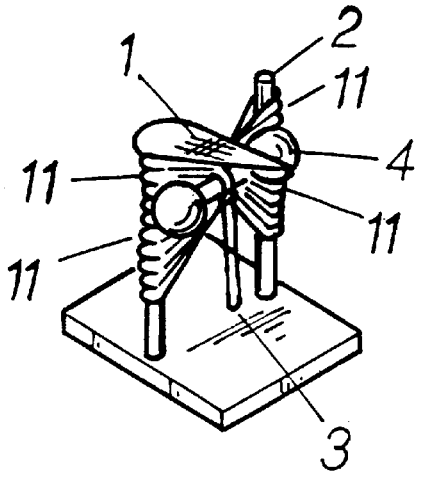
Figure 7:
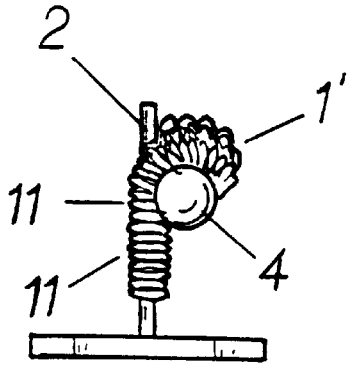
Figure 6:
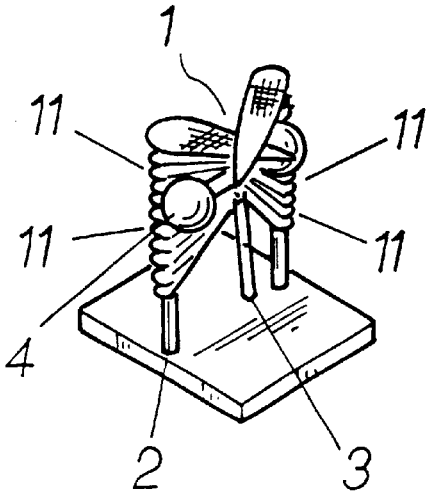
Figure 8:
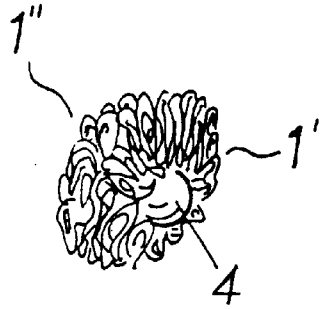
Figure 10:
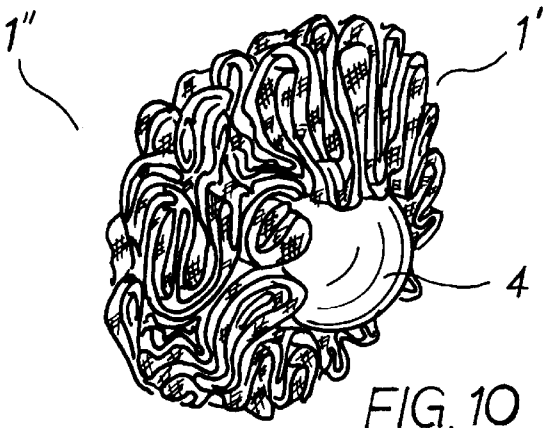
FIGS. 9 and 10 are isometric drawings of the invention herein.
Figure 11:
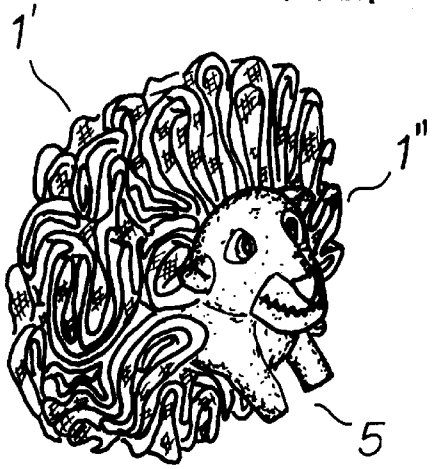
FIG. 11 is an isometric drawing of another embodiment of the invention herein.
Figure 9:
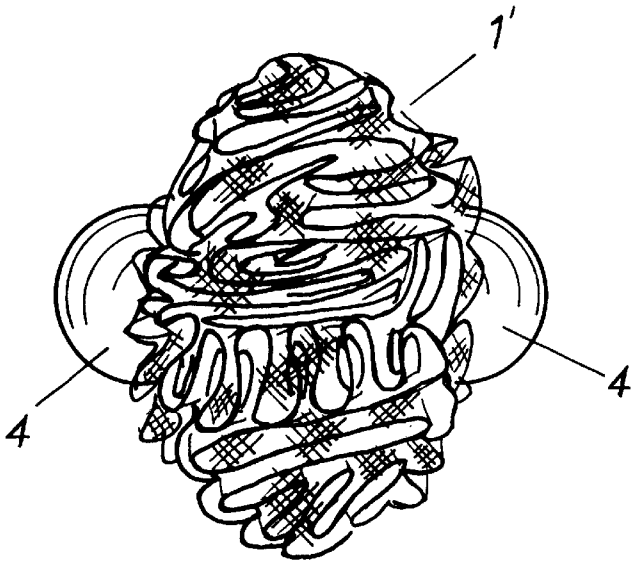

Referring to FIGS. 1–8, the bathing ball structure of the invention herein is comprised of a webbed band 1 consisting of a soft synthetic open-mesh material that is long and tubular, in a single color or combination of several colors, and having a variation of mesh shapes (such as rhombic and honeycomb). The soft synthetic material of the webbed band 1 is woven into a predetermined length and mesh shape, and the round end opening of the webbed band 1 is slipped vertically onto a U-shaped frame 2 and continuously pulled over until a number of annular plies 11 have accumulated. A binding cord 3 is then wound around the outer extent of the webbed band 1, at which time an I-shaped bar 4 having two hemispherical-shaped ends or a three-dimensional ornament 5 modelled on animals or plants (such as lions, dolphins, flowers, and other forms) is inserted between the numerous annular plies 11 and the binding cord 3. After completion, the binding cord 3 wound around the annular plies 11 of the webbed band 1 is firmly tied to enable the two sides of the annular plies 11 to be removed by first lifting the left and then the right extent off the U-shaped frame 2, thereby producing an irregularly shaped puff-like object of graduated loops 1'. The loops 1' of the webbed band 1 cover the bathing ball or other decoration (as shown in FIGS. 9–11) forming a spherical bathing ball 1". As such this, enables the irregular loops 1' of the webbed band 1 on the surface of the bathing ball 1" to remain consistently saturated with a foam bathing solution for gentle scrubbing utilizing the bathing ball 1" which is continuously moved to cleanse the body, with the hemispherical-shaped massage ball 4 stroking the body at the same time to provide a comfortable message to the user. Furthermore, since various three-dimensional animal- or plant-form decorations 5 can be placed in the bathing ball 1", the invention herein encourages children to bathe on their own volition by effectively allowing for the structural enhancement of the appearance of the bathing ball.

Furthermore, the invention herein has already been manufactured as a finished product, proving that the said functions are genuine.

In summation, the structure created by the invention herein is practical, demonstrably progressive, and complies with all new patent right requirements and, therefore, the invention herein is hereby submitted to the patent bureau for review and the granting of the commensurate patent rights.

What is claimed is:

1. A method of making a bathing ball, comprising:

providing a tubular webbed band of a predetermined length;

providing a frame having a horizontal base, and two vertically-extending legs attached to the base in the form of a U;

slipping a round opening of the tubular webbed band over the two vertically-extending legs;

pulling the tubular webbed band toward the base to form a plurality of annular plies in a surface of the tubular webbed band;

winding a binding cord around an outer extent of the tubular webbed band;

inserting an I-shaped bar between the binding cord and the plurality of annular plies, the I-shaped bar having two three-dimensional items, the three-dimensional items being on opposing ends of the bar;

tying the binding cord; and removing the tubular webbed band from the frame by lifting one side of the tubular webbed band from off of one of the legs, then lifting another side of the tubular webbed band from off of another one of the legs, thereby forming an irregular puff-like object having graduated loops.

2. The method recited in claim 1, wherein said providing a tubular webbed band includes weaving a rhombic-shaped synthetic, open-mesh material into the tubular webbed band.

3. The method recited in claim 1, wherein said winding includes disposing the binding cord between the two vertically-extending legs, so that the binding cord extends over the round opening and over a further opposing opening of the tubular webbed band.

4. The method recited in claim 1, wherein the three-dimensional items are selected from the group including a hemispherical-shaped ball, an animal decoration, and a plant decoration.

5. The method recited in claim 4, wherein said removing causes the annular plies to surround the three-dimensional items.

6. The method recited in claim 5, wherein the operations are performed in the order given.

* * * * *